US005971906A

United States Patent [19]

Tharpe, Jr. et al.

[11] Patent Number: 5,971,906

[45] Date of Patent: Oct. 26, 1999

[54] TRAY FORMING APPARATUS AND METHOD

[76] Inventors: Johnny M. Tharpe, Jr., 1610 Louise Ave., Panama City, Fla. 32401; Robert M. Herrin, 5935 Groveline Dr., Orlando, Fla. 32810

[21] Appl. No.: 09/000,936

[22] Filed: Dec. 30, 1997

Related U.S. Application Data

[63] Continuation-in-part of application No. 08/758,095, Nov. 29, 1996, Pat. No. 5,782,732.

[51] Int. Cl.[6] ..... B31B 1/62

[52] U.S. Cl. ..... 493/131; 493/143; 493/124; 493/171

[58] Field of Search ..... 493/131, 141, 493/143, 124, 123, 130, 168, 171, 167, 169

[56] References Cited

U.S. PATENT DOCUMENTS

| | | | |
|---|---|---|---|
| 2,167,117 | 6/1939 | Evans et al. . | |
| 2,665,836 | 1/1954 | Rendall . | |
| 2,675,166 | 4/1954 | Main | 206/509 |
| 2,690,285 | 9/1954 | Main | 229/117.17 |
| 2,963,211 | 12/1960 | Agler . | |
| 3,002,672 | 10/1961 | Kotowick . | |
| 3,040,961 | 6/1962 | Meyers . | |
| 3,109,579 | 11/1963 | Crane . | |
| 3,425,544 | 2/1969 | Ayer et al. . | |
| 3,648,833 | 3/1972 | Dash . | |
| 3,978,774 | 9/1976 | Royal | 493/168 |
| 4,256,025 | 3/1981 | Goda et al. | 493/171 |
| 4,289,491 | 9/1981 | Collura et al. | 493/124 |
| 4,389,013 | 6/1983 | Hall et al. . | |
| 4,418,863 | 12/1983 | Kimbrell, Sr. . | |
| 4,460,349 | 7/1984 | Charron . | |
| 4,500,306 | 2/1985 | Nowacki . | |
| 4,513,907 | 4/1985 | Grosshuesch . | |
| 4,578,054 | 3/1986 | Herrin . | |
| 4,651,501 | 3/1987 | Matsuda et al. | 493/130 |
| 4,702,409 | 10/1987 | Osborne . | |
| 4,770,339 | 9/1988 | Weimer . | |
| 5,131,208 | 7/1992 | Paul et al. | 493/130 |
| 5,458,899 | 10/1995 | Floyd et al. . | |
| 5,782,732 | 7/1998 | Herrin | 493/131 |
| 5,807,223 | 9/1998 | Holton | 493/130 |

FOREIGN PATENT DOCUMENTS

| | | |
|---|---|---|
| 4102166A1 | 7/1992 | Germany . |
| 2 037 697 | 7/1980 | United Kingdom . |

*Primary Examiner*—Peter Vo
*Assistant Examiner*—Matthew Luby
*Attorney, Agent, or Firm*—Allen, Dyer, Doppelt, Milbrath & Gilchrist, P.A.

[57] ABSTRACT

A tray forming apparatus and method are provided which advantageously increase the quality and production speed of tray type containers. The apparatus takes a precut paperboard blank through loading, forming, glueing, and compressing phases of operation to form a tray, which phases include conveying blanks from a stacked position to forming the blanks in a partially folded position, gluing using only a single pair of glueing heads for minor panels of the blank, and compressing the folded blank for securing the folds in a structural position sufficient for relying on the strength of the paperboard during the stacking of loaded trays. The tray forming apparatus includes suction cup styled conveyors for moving the blank from a stored position to a position for folding, a platen that contacts a bottom panel of the blank and moves the blank through fold guiding arms for positioning the blank in a partially folded position between guide rails for movement downstream to additional folding arms that hold major panels and minor panels in a position for adding adhesive to the major panels just prior to compression of the partially folded blank into its fully folded position. By applying adhesive just prior to compression of the panels, and by securing the panels in a structurally sound position, the adhesive is effective in securing the blank into its fully formed tray and to forming the tray with folds that provide the structural support necessary to support stacking fully loaded trays without depending on the adhesive for such stacking.

51 Claims, 8 Drawing Sheets

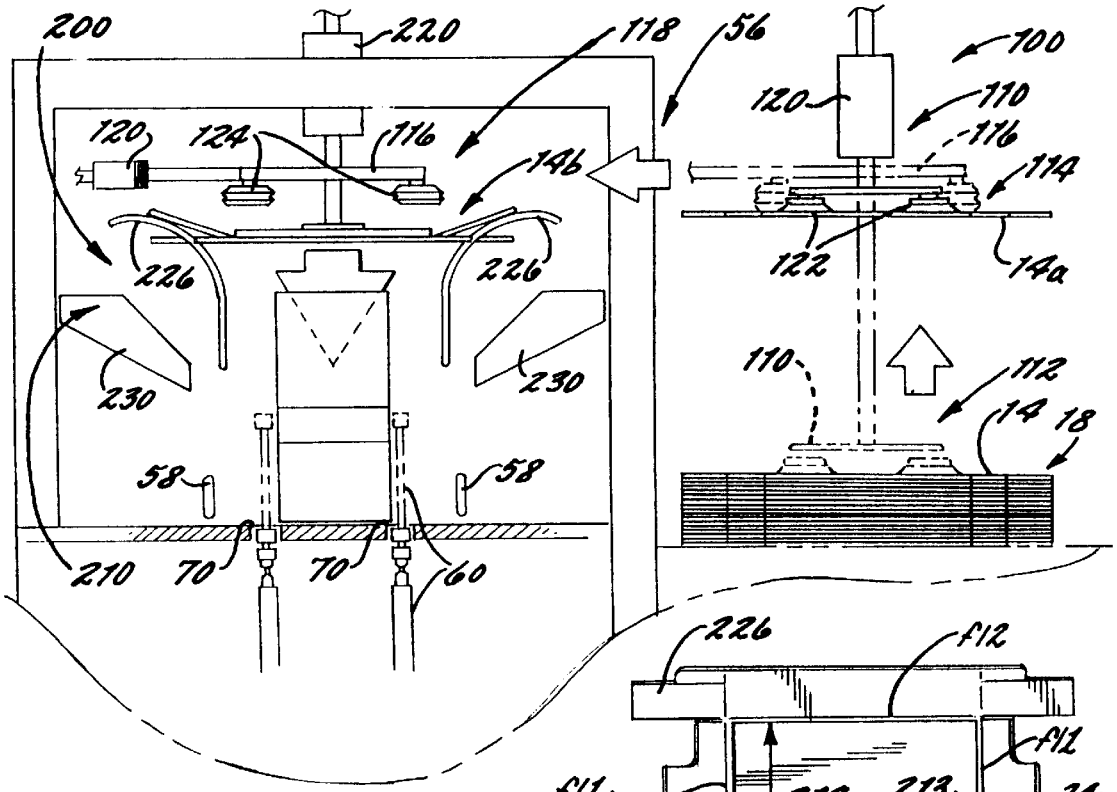
Fig. 9.
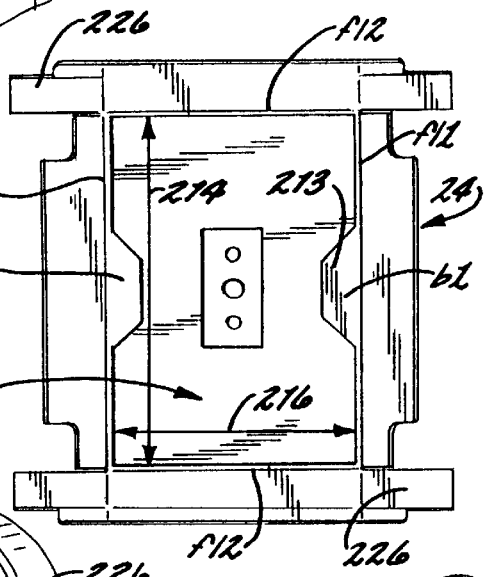
Fig. 10.
Fig. 11.
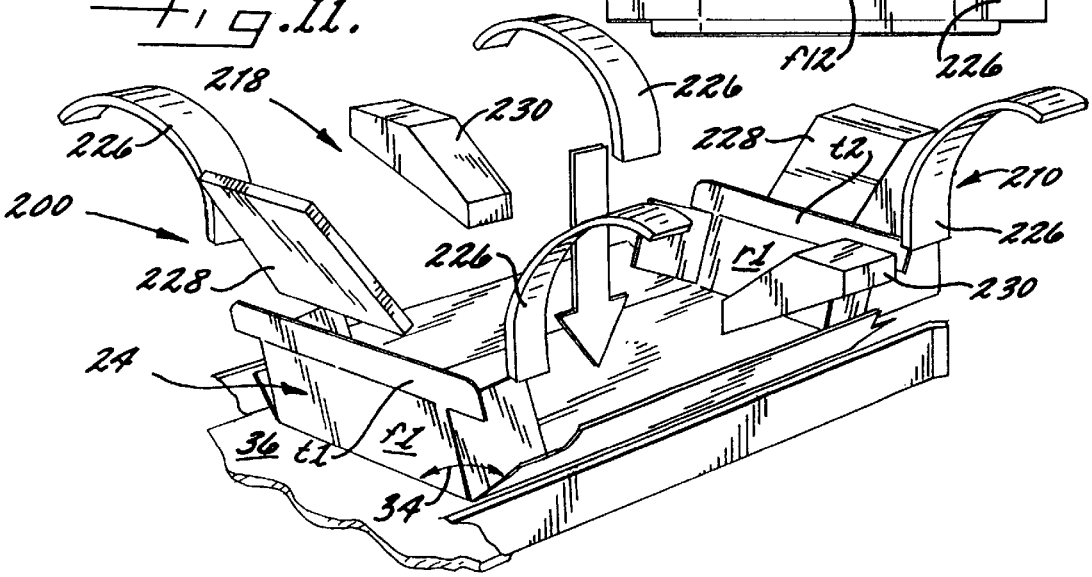

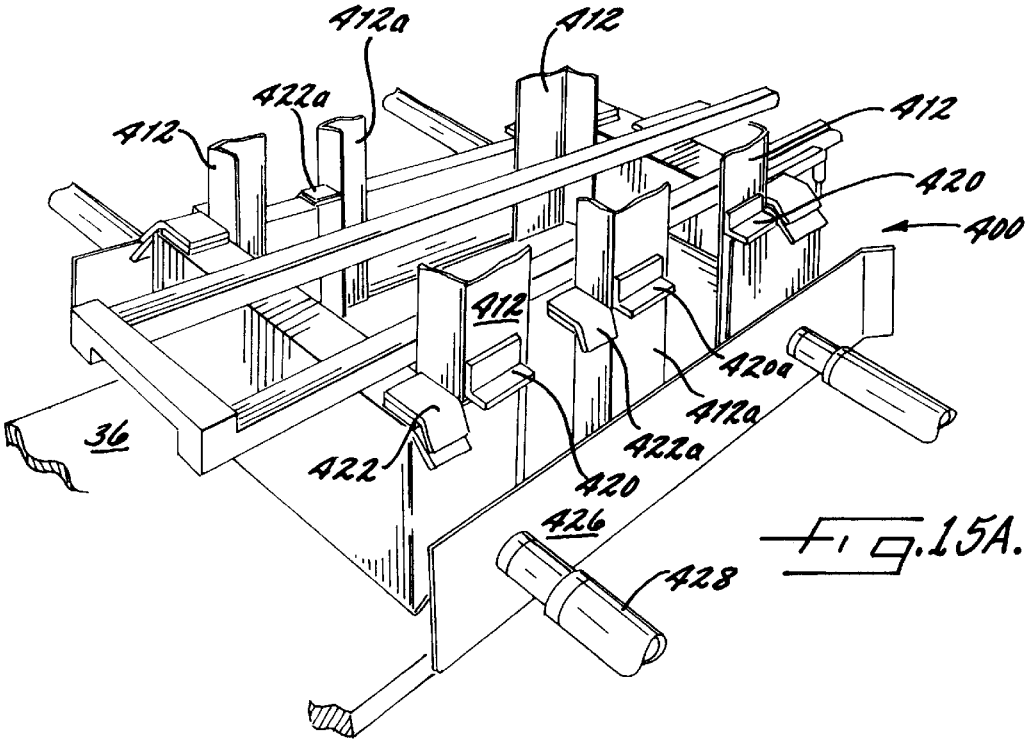
Fig. 15A.
Fig. 16.
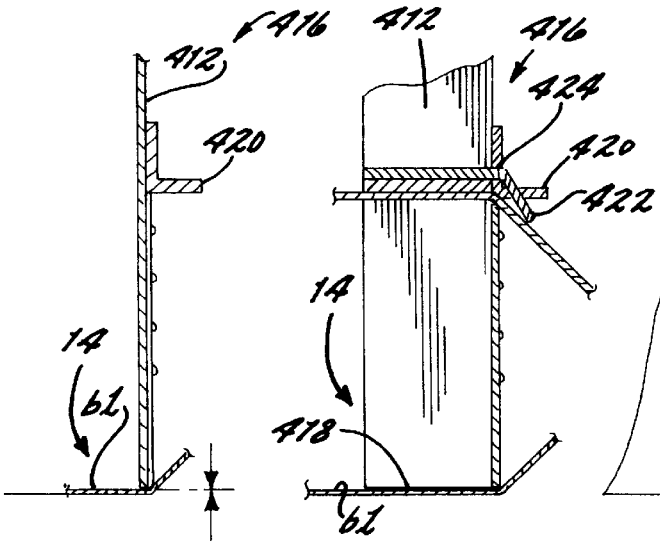
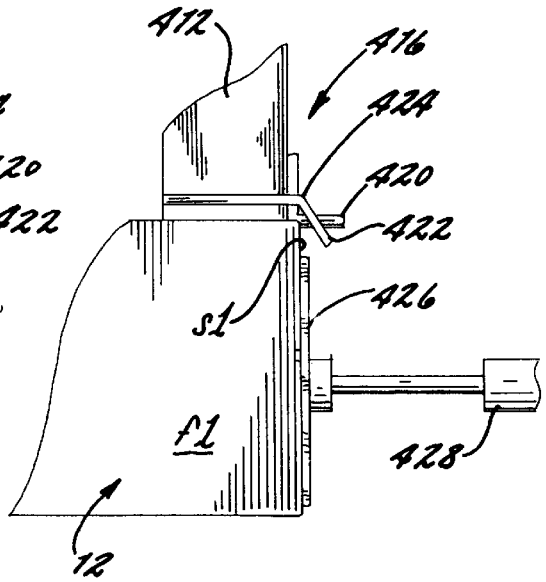
Fig. 17.
Fig. 18.

TRAY FORMING APPARATUS AND METHOD

CROSS REFERENCE TO RELATED APPLICATION

This application is a continuation-in-part of application Ser. No. 758,095 filed Nov. 29, 1996 for Tray Forming Apparatus And Method Of Forming Same, issuing as U.S. Pat. No. 5,782,732.

FIELD OF THE INVENTION

This application is related to containers and container systems and, more particularly, to a container forming apparatus and associated method.

BACKGROUND OF THE INVENTION

Paperboard trays useful for stacking and forming into a grocery store have become more and more popular and, as a result, the product industry and, in particular, citrus packing houses have had an increased demand for providing packaged fruit within paperboard trays such as those described in U.S. Pat. No. 4,418,863 to Kimbrell, Sr. Typically, and as addressed in the Kimbrell '863 patent, there is a need for reinforcing corners of the tray to support the stacking of such trays in shipping and displaying of product. As is recognized in the art, such trays are typically formed from a single generally rectangular shaped panel blank which has been suitably cut, scored and perforated to be folded into a completed tray for subsequent filling of product and shipping. The demand in the industry is such that the costs and extensive time associated with manually forming such trays are prohibitive. As a result, paperboard tray forming machines such as that described in U.S. Pat. No. 4,460,349 to Charron have come into wide use for automatically forming a paperboard tray from a flat production blank. As has been typical in the art, and described in the Charron '349 patent, by way of example, the paperboard tray forming machine passes the blank through various multiple folding stages where adhesive is applied to appropriate portions of the blank at selected stations for securing the formed blank into the finished tray. As one would expect in a tray having multiple folds, such a machine for duplicating the manual effort of the human hand can become complicated. As a result, it has become important to simplify both construction of the tray and the tray forming apparatus to improve on both the cost for each and the time required to form trays.

Especially in the citrus industry, by way of example, packing plants are often responsible for the harvesting of the product, sorting and grading the product, preparing the product for shipping by washing and waxing, and packing the product into such trays for shipment. Because of the various industry demands on these packing plants, such as the need for more timely deliveries, for lower and more control of labor costs, for more control over the sorting and grading, preparing, packing, shipping, storing, and providing a container for appropriate displaying, demands arise at various stages of these processes.

The present invention is directed to the needs arising in the supply speed and forming of tray type containers used for the packing, shipping, storing, and displaying of the product. Conventionally, tray type containers are formed of a paperboard or cardboard material such as earlier described, which is relatively inexpensive, lightweight, and in many cases recyclable. These tray type containers are shaped in size for particular purposes. Such purposes include the storing in a stacked arrangement for carrying and shipping on pallets and delivery to the retail store or displayed in the shipping container. As a result, it is important that the container remain as attractive as when it was first formed. As one might imagine, the delicate preparation and handling of such containers becomes costly and very time consuming. As a result, it becomes important to provide a container that is structurally sound and can meet the demands placed on it from the time it is filled with product at the packing house to the time it is displayed for viewing by the consumer. In addition, there is demand of forming such trays as quickly as possible to meet both the demand for the trays in shipping product as well as the efficiency required for reducing overall production and shipping costs.

SUMMARY OF THE INVENTION

In view of the foregoing background, it is therefore an object of the present invention to provide a tray forming apparatus and associated method for forming trays or tray type containers at a higher production speed. It is also an object of the present invention to provide a more efficient, less costly, tray forming apparatus for forming the trays in such a way that they can effectively support the loads and stacking of multiple trays during handling and storage.

These and other objects, features and advantages according to the present invention are provided by a tray forming apparatus that comprises conveyor means for conveying a blank from a stored position to a forming position, subsequent folding of the blank with folding means and adhesive applicators for ultimate folding of the blank and securing it into a tray. The apparatus comprises the first folding means for sequentially folding the front and rear minor side panels of the blank to a position that is generally perpendicular to their respective front and rear panels. The first folding means folds the front and rear panels of the blank upwardly and inwardly to a position that brings the panels to an angle that is approximately perpendicular to the bottom panel. The first folding means then folds the major side panels to a partially folded position at an obtuse angle to the bottom panel. The second folding means, positioned downstream from the first folding means, folds the major panels to a fully folded position generally perpendicular to the bottom panel thus placing the minor side panels in contact with the bottom panel. The second folding means comprises top panel guiding means for guiding each of the top major panels of the blank downwardly and inwardly such that the inner surface of each of the top major panels overlies the inner surface of the bottom panel of the blank and generally places each of the top major panels in contact with an edge of the minor side panels. Downstream of the second folding means is a pair of spaced apart adhesive applicators for applying adhesive only to the outer surface of each of the forward minor side panels and the rearward minor side panels during downstream travel of the partially folded blank. The second folding means cooperates with the applicators for holding the minor side panels in their fully folded position. Once adhesive has been applied, compressing means positioned downstream from the adhesive applicators, compresses the outer surfaces of the top minor panels and the outer surfaces of the major side panels against the outer surfaces of the minor side panels so that the inner surfaces of the top minor panels and the major side panels press against the outer surface of the inner side panels of the blank thereby adhesively secure the fully folded blank into an erected tray. With such comprising means, the strength of the box during stacking relies on the strength of the paperboard and not on the adhesive alone. The adhesive acts to hold the folded paperboard into its fully folded position.

In a preferred embodiment of the present invention, the conveyor means comprises vertical conveying means operable between a first position for receiving the blank, typically from a stack of blanks in a stored position, and a second position when the blank is lifted to a vertically displaced position above the stored position. In addition, horizontal conveying means operable between the vertically displaced position and the forming position, conveys the blank to a position wherein the blank will proceed through the forming steps. The first folding means comprises fold guiding means positioned for receiving the blank and supporting the blank from the minor side panels, a platen having a length and width dimension to fit within the length and width dimension of the bottom panel of the blank, and platen moving means for moving the platen from a first position above the blank to a position wherein the front and rear minor side panels are generally perpendicular to their respective front and rear panels. The first folding means further comprises a pair of opposing major side panel guide arms positioned for cooperating with the platen in folding the major side panels to a partially folded position at an obtuse angle to the bottom panel. Such a partially folded position permits adhesive to be applied to only the outer surface of each of the forward minor side panels and the rearward minor side panels during the downstream travel of the partially folded blank.

The tray forming apparatus comprises a frame defined by a rear portion, front portion, and a side loading portion. Guide rails extend from the rear portion to the front portion and guide the partially folded blank downstream. A conveyor guide arm is operable between the rear portion and the front portion of the frame for moving the blank downstream guided by the guide rails. The second folding means comprises a pair of skid guide arms positioned above the guide rails for receiving the partially folded blank there between and for cooperating with the conveyor guide arm for folding the major panels and the top major panels into their respective fully folded positions. The partially folded blank closely fits between the skid guide arms and the guide rails. Once the adhesive has been applied to the outer surface of each of the minor side panels, a compression arm movable from a stored position above the partially folded blank is moved to a compression position wherein a bottom portion of the compression arm is biased against the bottom panel. The compression arm comprises a first clamp carried by the compression arm and positioned by biasing its respective minor side panel against the bottom panel, a second clamp carried by the compression arm which has an angle bend for folding the top minor panel over and at an acute angle to the minor side panel, and a pair of opposing compression plates positioned for receiving the blank and its partially major side panels there between. The pair of opposing compression plates is movable for biasing the major side panels and top minor panels against their respective minor side panels having adhesive thereon for fully folding the blank into the tray.

The tray forming apparatus further comprises distribution means positioned downstream from the compressing means for receiving the completed tray as a second tray being formed is moved downstream by the conveyor guide arm and moves the completed tray to the distribution means.

In a method aspect of the present invention, it can be appreciated that the apparatus forms blanks into trays in what can be described as four phases. The first phase, a conveying phase, conveys or moves a blank from a stack of blanks to a position within the apparatus for operation with first folding means. The second phase is a forming phase which includes the partial folding of the blank as earlier described with reference to the first folding means and second folding means. A third phase includes applying adhesive to only the outer surfaces of each of the minor side panels during the shuttling or moving of the partially formed blank downstream. Finally, a fourth phase, or compression phase, includes compressing the partially folded top minor panels and major side panels against the surface of the minor panels having adhesive, while the minor panels are secured in a position biased against the bottom panel thus providing the structural support from the minor panels without relying on the adhesive as a way of supporting the trays when in a filled and stacked position.

BRIEF DESCRIPTION OF THE DRAWINGS

A preferred embodiment of the present invention as well as others that will become more apparent by referring to the following detailed description and drawings in which:

FIG. 9 is a partial cross-sectional elevation view of a forming portion of a preferred embodiment of the present invention taken through lines 9—9 of FIG. 1;

FIG. 10 is a top plan view of the forming portion of FIG. 9 taken through lines 10—10 of FIG. 9;

FIG. 11 is a perspective view of the forming portion of FIG. 9 illustrating a partially formed blank;

FIGS. 15 and 15A are perspective views of alternate embodiments of the compressing portion of the embodiment of FIG. 1;

FIG. 16 is a partial cross-section view taken through lines 16—16 of FIG. 15;

FIG. 17 is a partial cross-section view taken through lines 17—17 of FIG. 15;

FIG. 18 is a partial elevation view of a corner portion of a tray during a compressing phase of the present invention.

DETAILED DESCRIPTION OF PREFERRED EMBODIMENTS

The present invention will now be described more fully with reference to the accompanying drawings in which preferred embodiments of the invention are shown and described. It is to be understood that the invention may be embodied in many different forms and should not be construed as limited to the illustrated embodiments set forth herein. Rather, the applicant provides these embodiments so that this disclosure will be thorough and complete, and will convey the scope of the invention to those skilled in the art. Like numbers refer to like elements there through.

Figure 1:
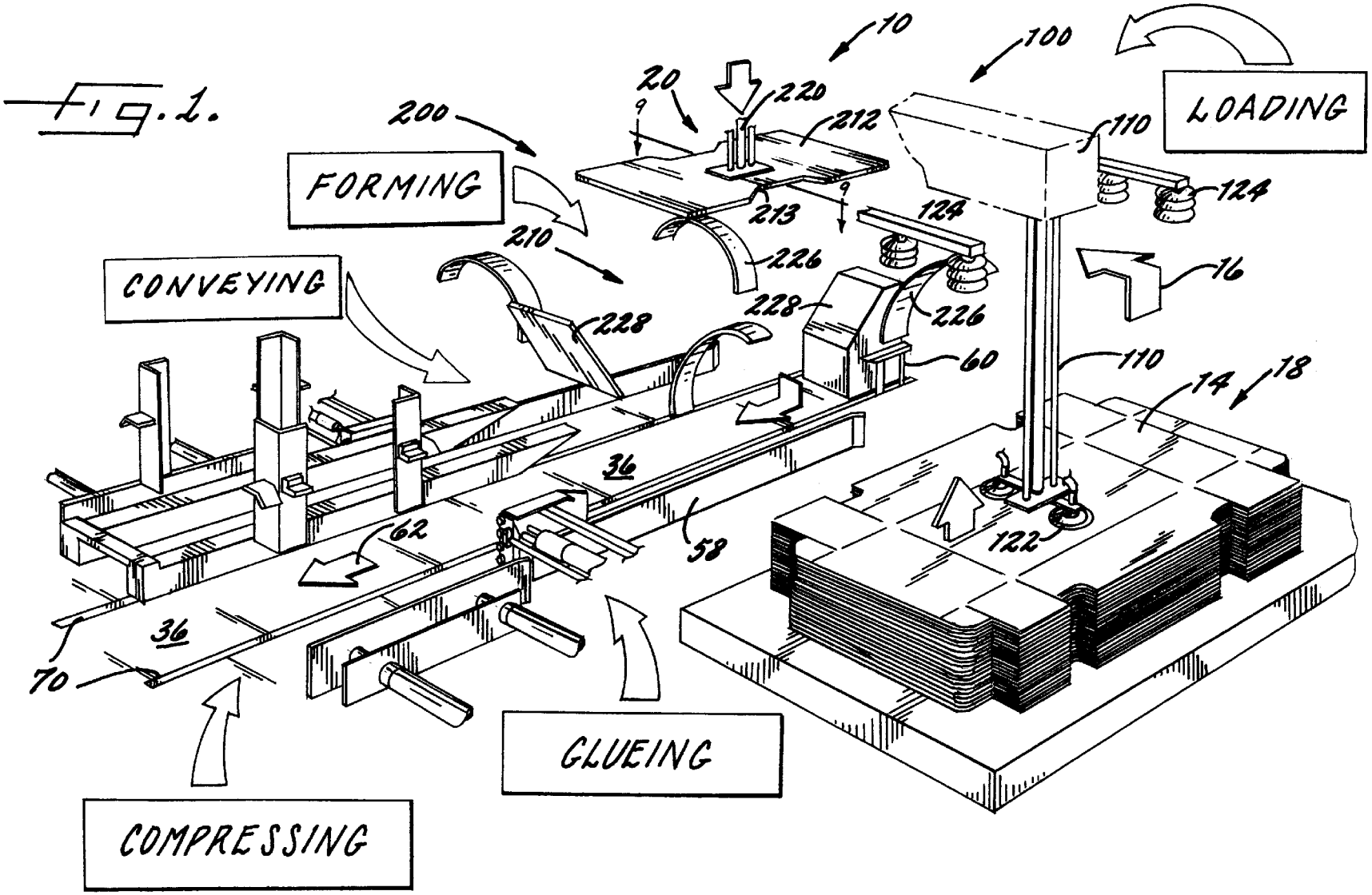
FIG. 1 is a partial perspective view of a preferred embodiment of a tray forming apparatus of the present invention.
Figure 2:
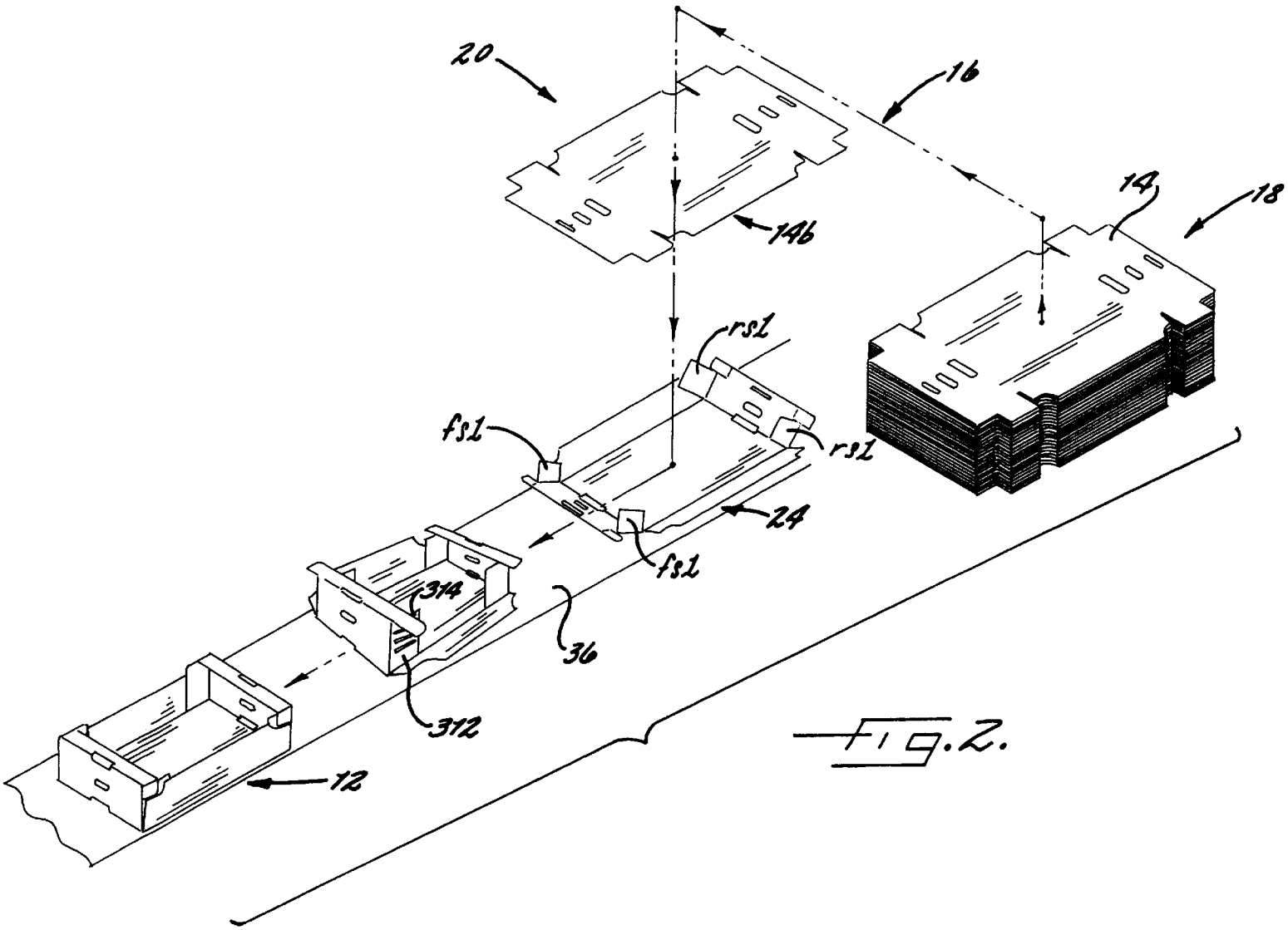
FIG. 2 is a perspective view illustrating phases in a transformation of a paperboard blank to a formed tray according to the present invention.
Figure 4:
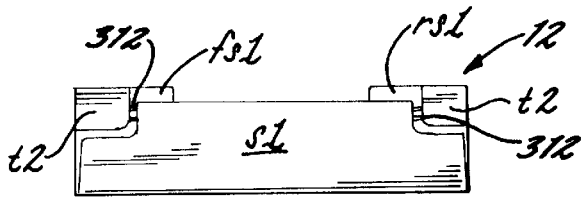
FIG. 4 is a side elevation view of a tray formed by use of a tray forming apparatus according to the present invention.
Figure 3:
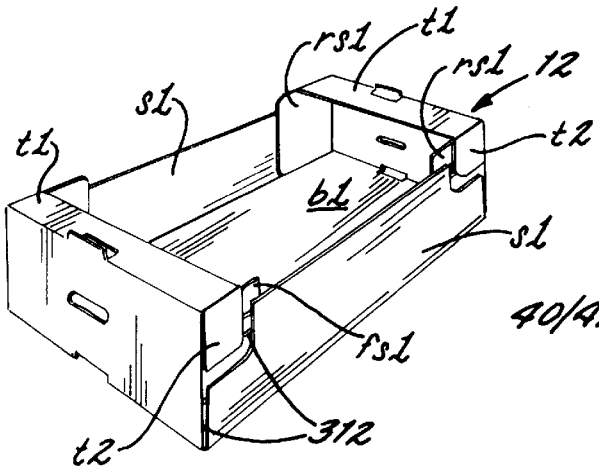
FIG. 3 is a perspective view of a tray formed by use of a tray forming apparatus according to the present invention.

As illustrated initially with reference to FIGS. 1 and 2, a preferred embodiment of the present invention, a tray forming apparatus 10 for forming a tray 12 from a paperboard blank 14 comprises loading means 100 for conveying the blank 14 along a predetermined loading path 16 from a stored position 18, wherein a plurality of blanks are stacked in preparation for operating the apparatus 10 to an initial folding position 20 within a frame 22 of the apparatus 10 for initially folding into a partially folded blank 24, shuttled downstream along a path of travel 26 where the partially folded blank is further folded into a partially formed tray 28, and shuttled further downstream for glueing and compressing into the fully formed tray 12. The apparatus is further described, again with reference to FIG. 1, by a folding portion 200, glueing portion 300, and compressing portion 400. Such features as the four portions, loading 100, folding 200, glueing 300, and compressing 400 will help the reader appreciate the simplicity of structure and four phases of operation for the apparatus 10 and how it accomplishes the improved speed with which it forms trays. The preferred embodiment herein described will produce upwards of 12 to 18 trays a minute, more than doubling that known in the art. The four phases permit overlapping formation of each tray by partially forming each tray, as will herein be described in further detail. Typical tray forming devices known in the art form a single tray at a time.

Before continuing with the detailed description of the apparatus, and with reference to FIGS. 3–8, next consider a description of the paperboard blank 14 and tray 12, the work piece to which the present invention is directed, by way of example. The fully formed tray 12 illustrated with reference again to FIGS. 3 and 4 is to be formed to meet a requirement that any given tray filled with fruit 38, by way of example, must support upwards of eleven or twelve trays stacked on itself, as illustrated with reference to FIG. 5, typical for storing and shipping trays 12 on a pallet 40 which will transport sixty filled trays to market. Each tray 12 includes a tab 40 and slot 42 for mating with adjacent trays, as well as a handle hole 44 useful in lifting each tray. As illustrated with reference to FIGS. 6–8, the blank 14 can be described as having a plurality of cuts and fold lines, the blank having a bottom panel b1, a pair of major side panels s1 connected to the bottom panel along a common fold line fl1, front and rear panels f1, r1, each connected to the bottom panel along respective common fold lines fl2, a pair of front minor side panels fs1 each respectively connected along common fold lines fl3 to the front panel, a pair of rear minor side panels rs1, each respectively connected to the rear panel along fold lines fl3, a pair of top major panels t1, each respectively connected to the front and rear panels along a common fold line fl4, a pair of top minor panels t2, connected to each of the top major panels along common fold lines fl5.

Continuing now with the detailed description of a preferred embodiment of the present invention, with reference to FIG. 9 and again with reference to FIGS. 1 and 2, the tray forming apparatus 10 includes the loader 100 which includes a vertical conveyor 110 operable between a first position 112 for receiving the blank 14 from a stack of blanks 18 in a stored or first position 112 and a second position 114 for lifting one blank 14*a* to the second position 114 wherein the blank 14*a* is vertically displaced above its earlier stored position 112. The loader further includes a horizontal conveyor 116 operable between the second position 114 and a third position 118 within the apparatus 10 for initiating folding of the blank 14*b*, the horizontal conveyor 116 is operable with the vertical conveyor 110 for sequentially conveying the blank 14 from the stored position 112, the first position to the initial folding position 118. In a preferred embodiment, pneumatics are employed for controlling vacuum cups 122, 124 positioned on the vertical and horizontal conveyors 110, 116 for contacting a surface of one blank 14, and attaching to the blank under pressure sufficient for the vertical conveyor 110 to lift one blank, and for the horizontal conveyor 116 to retrieve the blank from the vertical conveyor through a vacuum control of the pneumatics 120. The blank 14 is thus moved from its stored position 112 to its initial forming position 118 ready for operation in the folding portion 200 of the apparatus 10. In the preferred embodiment, a vacuum sensor detects the pressure on each cup 122, 124 and will only permit the conveyors 110, 116 to operate when sufficient pressure is available for lifting the blank 14. Further, the operation of each conveyor 110, 116 is coordinated for momentarily interrupting pressure to the vertical conveyor 110 for transferring carrying of the blank 14 from the vertical to the horizontal conveyor 116.

With reference now to FIGS. 10 and 11, and again to FIGS. 1 and 9, the folding portion 200 includes first folding guides 210 for folding the blank 14*b* into a partially folded blank illustrated by numeral 24 by folding the front and rear minor side panels fs1, rs1 to a position generally perpendicular to their respective front and rear panels f1, r1, folding the front and rear panels f1, r1 of the blank 14 upwardly from the bottom panel b1 and inwardly to a position approximately perpendicular to the bottom panel b1, and folding the major side panels s1 to a partially folded position at an obtuse angle 34 to the bottom panel. The first folding guides 210 places the bottom panel b1 onto a shuttle surface 36 of the apparatus 10. As illustrated again with reference to FIGS. 9–11, the first folding guides 210 comprise a platen 212 having a length and width dimension 214, 216 proximate the length and width dimension of the bottom panel b1 for loosely fitting within the bottom panel of the blank 14 and causing an effective folding along the fold lines fl1, fl2 when interacting with folding guide arms 218. The folding guide arms 218 cooperating with the platen 212 for receiving the blank 14*b* and inwardly folding the minor side panels fs1, rs1, front and rear panels f1, r1. Again, pneumatics 220 are used for driving and moving the platen 212 from a first position 222 above the blank 14*b*, biasing against the blank when in the initial folding position, and moving the blank through the folding guide arms 218 to a position 224 on the shuttle surface 36 wherein the front and rear minor side panels fs1, rs1 are generally perpendicular to their respective front and rear panels f1, r1.

As illustrated with reference again to FIGS. 9–11, the folding guide arms 218 of one preferred embodiment, herein described, comprise four minor side panel guide elements 226 positioned for cooperating with the platen 212 in receiving and folding the minor side panels fs1, rs1. A pair of opposing front and rear panel guide elements 228 are positioned for receiving the blank 14*b* after receipt by the minor side panel guide elements 226. A pair of opposing major side panel guide elements 230 positioned below the minor side panel guide elements 226 for cooperating with the platen 212 in folding the major side panels s1 to the partially folded position as designated for the blank 14 by numeral 24 at the obtuse angle 34 to the bottom panel b1. As will be described, the obtuse angle 34 should be sufficient for cooperating with adhesive applicators in permitting the application of adhesive only to the outer surface of each minor side panel fs1, rs1. As earlier described, the platen 212 can be dimensioned to loosely fit around the perimeter of the bottom panel b1 for permitting a uniform folding of fold lines fl1 and fl2 because the platen 212 is used to only partially fold the major side panels s1 and front and rear panels f1, r1, and not fold the top major panels t1, t2, thus permitting removal without hitting the top major panels. In a preferred embodiment, cutout portions 213 on the long dimension side are provided to avoid contacting the major side panel guide arms 230 without reducing the effectiveness of the folding process.

Figure 12:
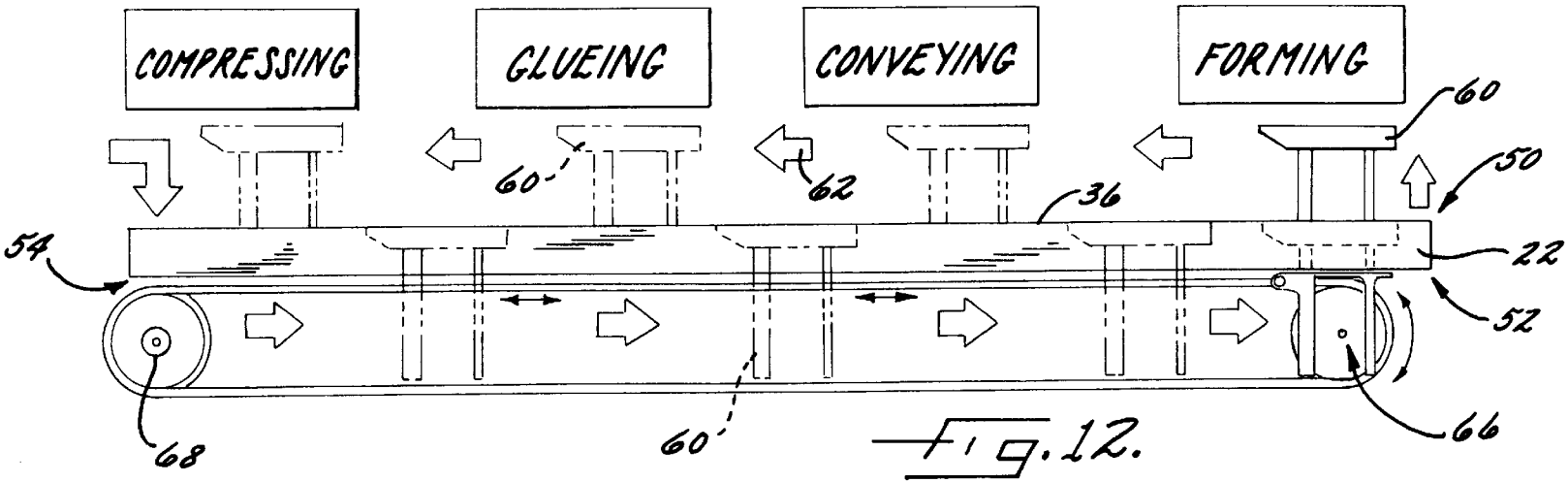
FIG. 12 is a partial cross-sectional view of a shuttle mechanism of the present invention illustrating various positions of a shuttle arm during the tray forming process.

Once in the partially folded position 24 illustrated with reference again to FIG. 11, the partially folded blank 14 is moved downstream using a shuttle assembly 50 for conveying the partially formed blank 14 downstream from the first folding guides 210 along the shuttle surface 36 of the apparatus 10. As illustrated with reference to FIG. 12 and again to FIG. 9, the frame 22, earlier described can further be described as having a rear portion 52, a front portion 54, and a side loading portion 56. The shuttle surface 36 is carried within guide rails 58 extending along the shuttle surface from the rear portion 52 to proximate the front portion 54 of the frame 22. The shuttle assembly comprises a pair of shuttle guide arms 60 operable between the rear portion 52 and the front portion 54 of the frame 22 for moving the partially formed blanks downstream, indicated by arrows 62 as guided by the guide rails 58. A shuttle arm drive 64 is carried by the frame 22 and is operable with the shuttle guide arms 60 for moving the partially folded blanks 14 downstream 62. A single pair of shuttle guide arms 60 are used and pass through a cycle of pushing the blanks 14 when raised above the shuttle surface 36, backing up after reaching the front portion 54, retracting below the surface 36 and returning to the rear portion 52 where they are raised above the surface 36 for repeating the cycle. A variety of methods can be used for such a cycle, the present embodiment employs a cam, chain and pulley system 66 with a driven pulley 68. The shuttle guide arms 60 travel through tracks 70 as illustrated with reference to FIGS. 1 and 9.

Figure 13:
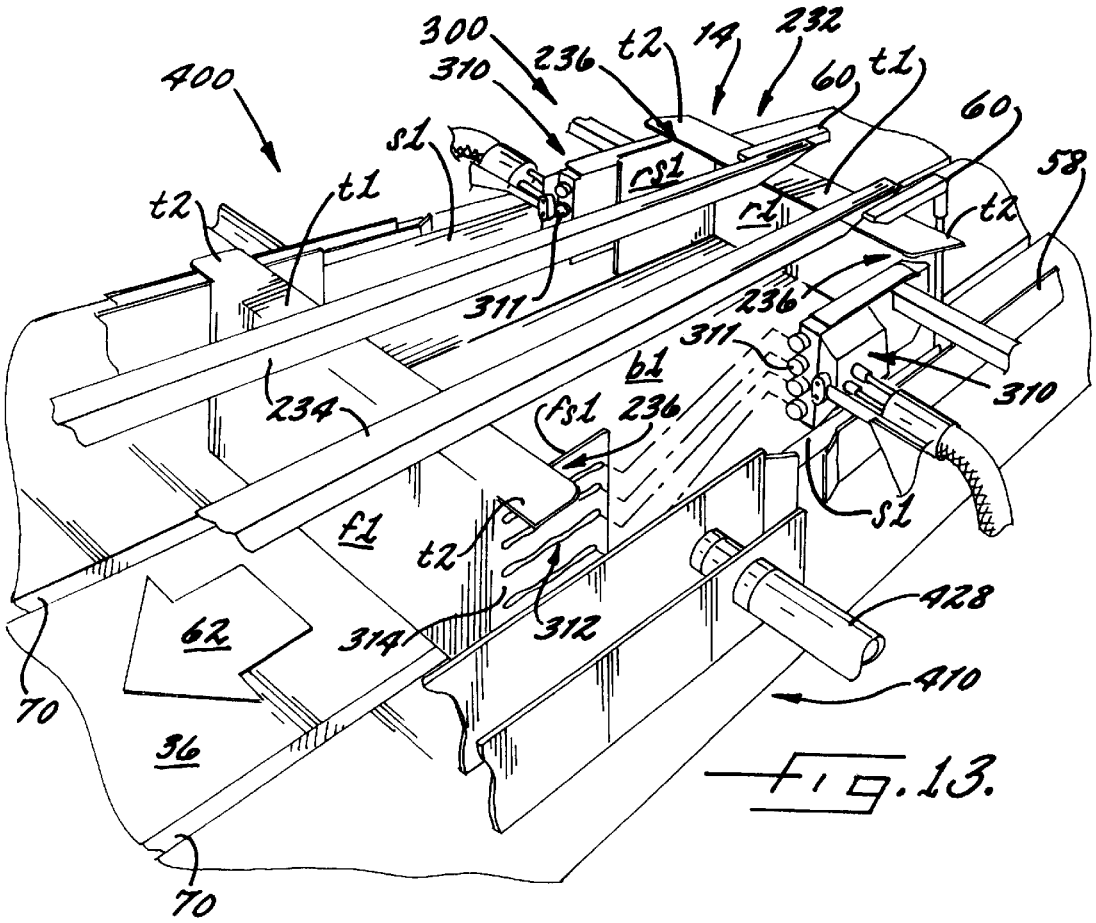
FIG. 13 is a perspective view of a glueing portion of the embodiment of FIG. 1 illustrating a partially formed blank passing through a glueing phase of the present invention.
Figure 15:
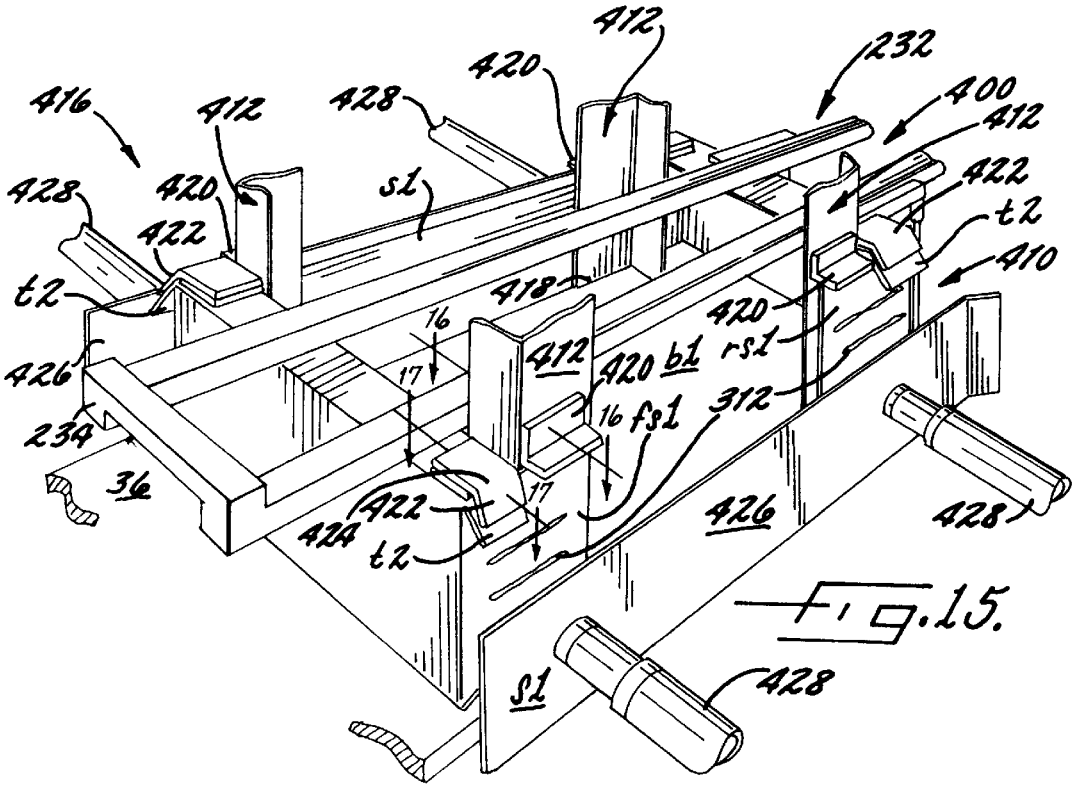

As illustrated with reference to FIG. 13, and again to FIG. 1, second folding guides 232 are positioned downstream from the first folding guides 210 and cooperate with the shuttle guide arms 60 for folding the front and rear panels f1, r1 to a fully folded position generally perpendicular to the bottom panel b1, thus placing the minor side panels fs1, rs1 in contact with the bottom panel b1. The second folding guides comprise a pair of top panel guide arms positioned above the shuttle surface 36. When the partially formed blank 14 is pushed between the top panel guide arms 234 and shuttle surface 36 by the shuttle guide arms 60 moving down stream 62, the top major panels t1 and the front and rear panels f1, r1 are biased into their respective fully folded positions, the top major panels being biased downwardly and inwardly such that the inner surface of each of the top major panels overlies the inner surface of the bottom panel and places each of the top major panels in contact with an edge of the minor side panels, as illustrated by numeral 236. During this downstream movement and folding by the second folding guides 232, a single pair of spaced-apart adhesive applicators 310 are positioned in this glueing portion 300 of the apparatus 10 for applying adhesive 312 only to the outer surface 314 of each of the forward minor side panels fs1 and the rearward minor side panels rs1 during downstream travel thereof as the partially folded blank 14 is guided downstream 62 by the shuttle guide arms 60 and travels between each of the pair of spaced-apart adhesive applicators 310. As herein described and illustrated, the second folding guides 232 cooperate with the applicators 310 for holding the minor side panels fs1, rs1 in their fully folded position. As earlier described, the obtuse angle 34 is sufficient for cooperating with adhesive applicators 310 in permitting the application of the adhesive 312 only to the outer surface 314 of each minor side panel fs1, rs1. In as preferred embodiment of the present invention, the adhesive applicators 310 comprise a glue gun 311 positioned for depositing hot glue onto the minor side panels fs1, rs1. It should be appreciated that the use of only a single pair of applicators 310 reduces the cost and maintenance for the apparatus 10, one object of the present invention.

As illustrated with reference to FIGS. 14–19, and again to FIGS. 1 and 13, the compressing portion 400 includes a compressing assembly 410 positioned downstream from the adhesive applicators 310 for compressing the top minor panels t2 and the major side panels s1 against the minor side panels fs1, rs1 having adhesive 312 on their respective outer surfaces 314 so that the inner surfaces of the top minor panels t2 and the major side panels s1 press against the glued outer surfaces to thereby adhesively secure what was originally the flat blank 14 into the erected tray 12. In a preferred embodiment of the present invention, the compressing assembly 410 comprises a compression arm 412 for each of the front and rear minor side panels fs1, rs1, as illustrated with reference to FIG. 15. The compression arms 412 are movable from a stored position 414 above the partially formed blank 14, as illustrated, by way of example with reference to FIG. 14, to a compression position 416, as illustrated with reference to FIGS. 15–18, wherein an end portion 418 of the compression arm 412 is biased against the bottom panel b1. As illustrated with reference again to FIGS. 15 and 16, a first clamp 420 is carried by each compression arm 412. The first clamp 420 is positioned for biasing its respective minor side panel fs1, rs1 against the bottom panel b1 when the compression arm 412 is in the compression position 416 with its arm bottom portion 418 biased against the bottom panel b1. A second clamp 422 is also carried by each compression arm 412 and includes an angle bend 424 for folding the top minor panel t2 over and at an acute angle to the minor side panel fs1, rs1. A pair of opposing compression plates 426 are positioned for receiving the partially folded blank 14 with its partially folded major side panels between the pair of opposing compression plates. The plates 426 are movable using pneumatically driven pistons 428 attached thereto for contacting and biasing the major side panels s1 and top minor panels t2 against their respective, glued minor side panels fs1, rs1 for fully folding the blank into the tray 12. As illustrated with reference again to FIG. 13, the guide rails 58 end before reaching the compressing portion 400, thus avoiding interference with the compression plates 426.

Figure 5:
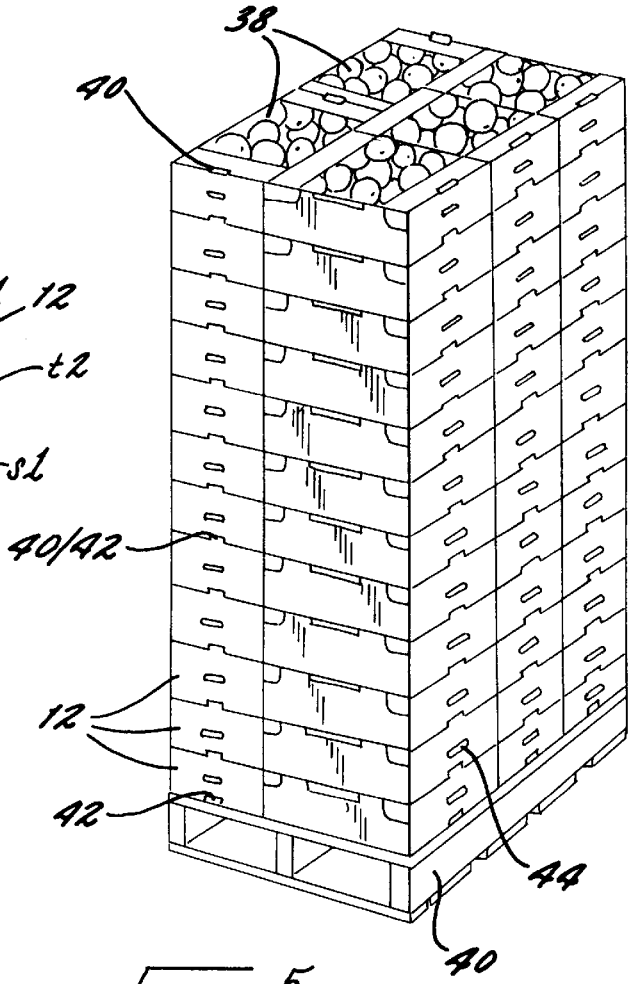
FIG. 5 is a perspective view of filled and stacked trays prepared for shipping on a pallet.
Figure 6:
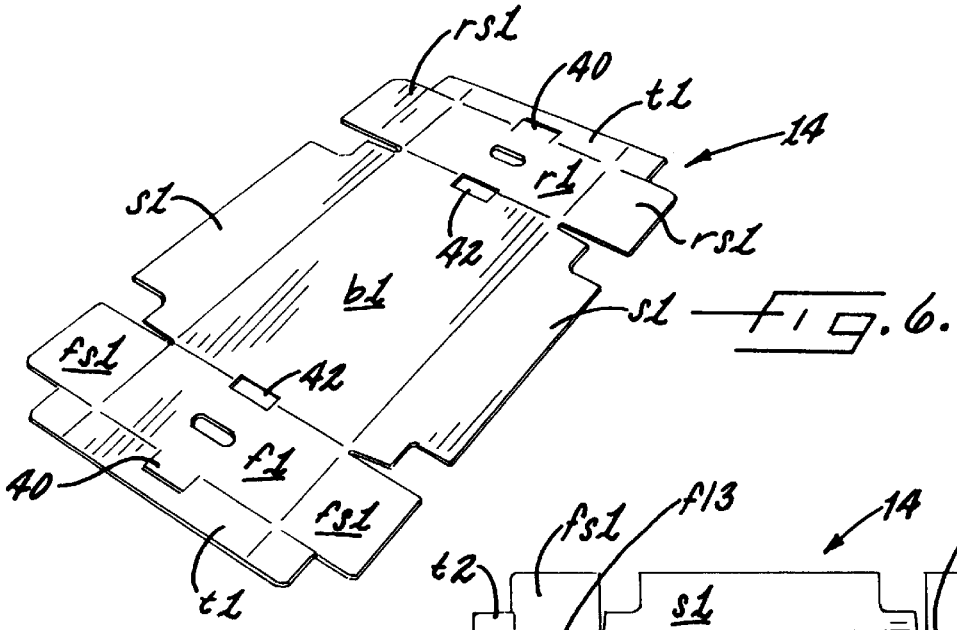
FIG. 6 is a top perspective view of a paperboard blank for forming a tray by use of a tray forming apparatus according to the present invention.
Figure 7:
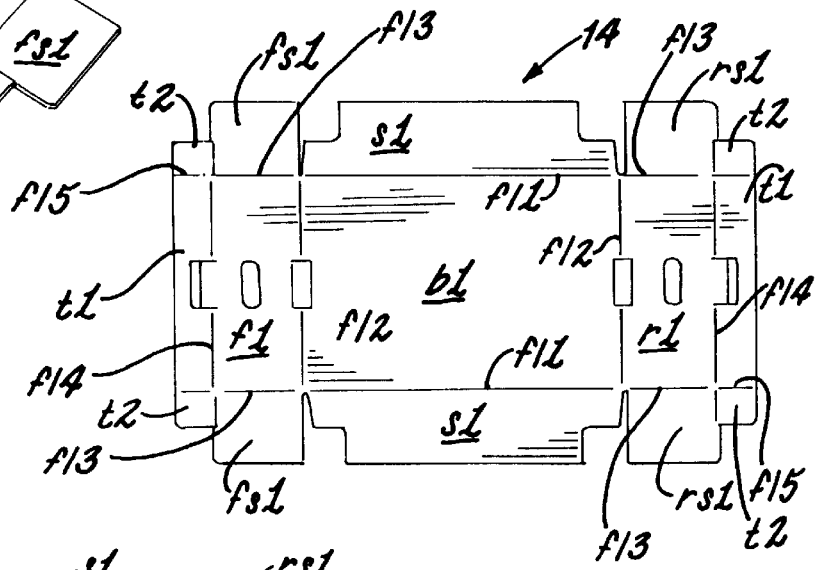
FIG. 7 is a top plan view of the blank of FIG. 5.
Figure 8:
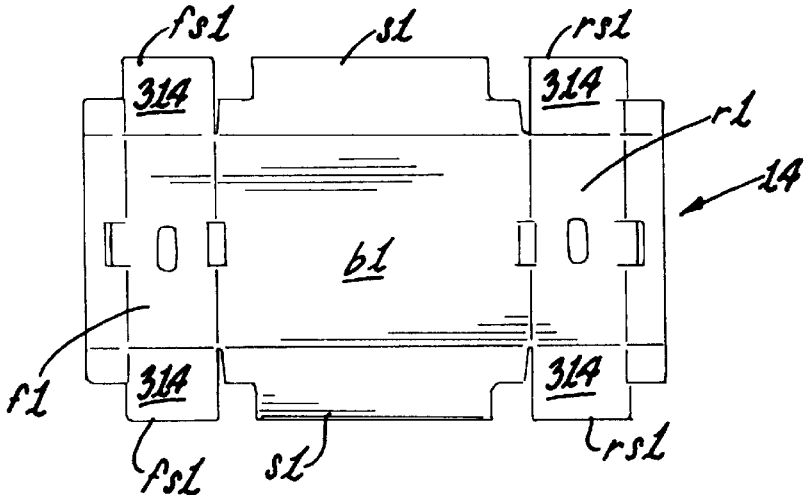
FIG. 8 is a bottom plan view of a blank of FIG. 5.

It should be pointed out that the biasing of the minor side panels fs1, rs1 against the bottom panel b1 by the action of the first clamps 420, and the biasing of the top major panels t1 against the minor side panels fs1, rs1 by the second clamps 422 assure that the paperboard structure supports trays 12 stacked upon each other as earlier described with reference to FIG. 5, and not merely glue as would be the case if the minor side panels were not fully biased against the bottom panel but at some angle to the major side panels thus relying on glued surfaces for vertical strength, as has been a problem in the art until the present invention satisfied this need for a securely formed tray 12.

As illustrated with reference to FIG. 15A, an alternate embodiment of the compressing portion 400, includes a second pair of compression arms 412*a* positioned between the arms 412, earlier described for accommodating half sized trays. In this way, all that is necessary to operate the apparatus 10 in forming half size trays of the style described with reference to FIGS. 3–8, is a platen replacement to a platen having a length ands width dimension that accommodates the half sized tray bottom panel. Such an accommodation satisfies a need in the industry.

Figure 19:
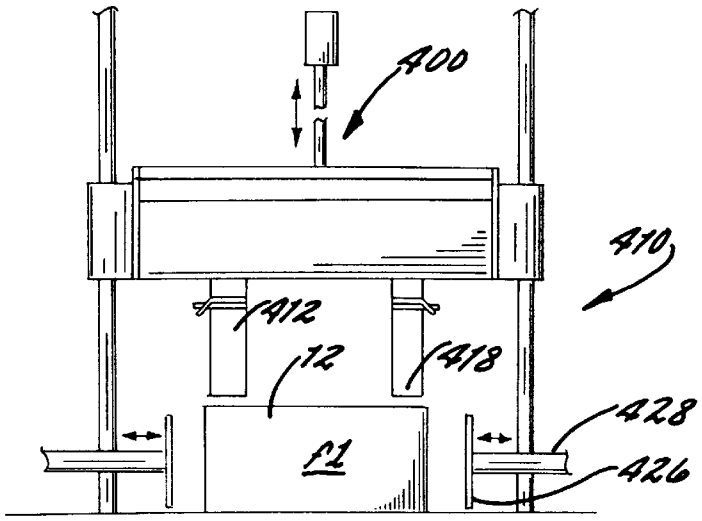
FIG. 19 is a partial front elevation view of a compressing portion of FIG. 1 illustrating the fully formed tray prior to removal from the apparatus.
Figure 14:
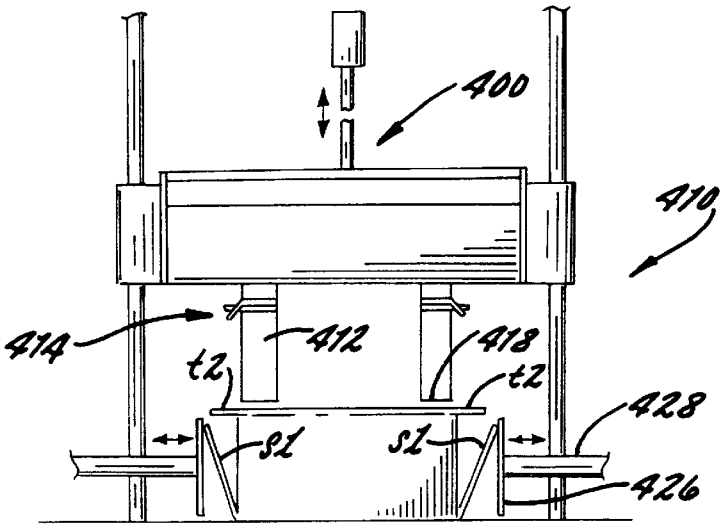
FIG. 14 is a partial front elevation view of a compressing portion of FIG. 1 illustrating the partially formed and glued blank prior to compression and forming into a fully formed tray.

To further expedite the tray forming process, and simplify the structure of the apparatus 10, the fully formed tray 12 is pushed further down stream after compression when the compressing assembly 410 is raised above the surface 36 and tray 12, as illustrated with reference to FIG. 19. With compression plates 426 retracted, the advancing partially folded blank, pushed by the shuttle guide arms pushes the fully formed tray out of the apparatus front end portion, typically onto a conveyor belt for delivery to a fruit loading station.

In the operation of the apparatus 10 for forming the tray 12 from the blank 14, it should be noted that the flat blank 14 is loaded from the side 56 of the frame 22 as was described with reference to FIGS. 1, 2, and 9. Loading can be accomplished from either side or the rear 52. However, in the interest in reducing the path length for forming the trays, the blanks are loaded from the side, thus reducing the travel path by the difference between the length and the width of the blank. Further, by only partially forming the blanks along the downstream path, multiple blanks can be partially formed, unlike that which is typical in the art where a single tray is formed at a time. As earlier described with reference to FIG. 12, the shuttle assembly 50 comprises a pair of shuttle guide arms 60 operable between the rear portion 52 and the front portion 54 of the frame 22 for moving the partially formed blanks downstream, indicated by arrows 62 as guided by the guide rails 58. A shuttle arm drive 64 is carried by the frame 22 and is operable with the shuttle guide arms 60 for moving the partially folded blanks 14 downstream 62. A single pair of shuttle guide arms 60 are used and pass through a cycle of pushing the blanks 14 when raised above the shuttle surface 36, backing up after reaching the front portion 54, retracting below the surface 36 and returning to the rear portion 52 where they are raised above the surface 36 for repeating the cycle. During the retracting and passing under the surface 36, the shuttle guide arms 60 pass under a following blank, thus permitting the partial folding of a plurality of blanks without waiting for the complete forming of a single tray. This provides enhanced speed of tray formation and a much improved production rate when compared to that known in the art. It should also be noted that by glueing close to compressing enhances the effectiveness of attachment of cooperating panels. Typically in the art of forming such trays 12, as herein described, it has been known to apply adhesive at the loading stage, thus adversely affecting the drying process of the glue being applied.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and alternate embodiments are intended to be included within the scope of the appended claims.

That which is claimed is:

1. A tray forming apparatus for forming a tray from a paperboard blank having a plurality of cuts and fold lines, the blank having a bottom panel, a pair of major side panels connected to the bottom panel along a common fold line, front and rear panels, each connected to the bottom panel along respective common fold lines, a pair of front minor side panels each respectively connected along common fold lines to the front panel, a pair of rear minor side panels each respectively connected to the rear panel, a pair of top major panels each respectively connected to the front and rear panels along a common fold line, a pair of top minor panels connected to each of the top major panels along common fold lines, the tray forming apparatus comprising:

loading means for conveying a blank along a predetermined path from a stored position to an initial folding position within the apparatus for folding into a partially formed tray;

first folding means for folding the blank into a partially formed condition by folding the front and rear minor side panels to a position generally perpendicular to their respective front and rear panels, folding the front and rear panels of the blank upwardly from the bottom panel and inwardly to a partially upright position, and folding the major side panels to a partially folded position at an obtuse angle to the bottom panel, the first folding means positioning the bottom panel onto a shuttle surface of the apparatus;

shuttle means for conveying the partially formed blank downstream from said first folding means along a shuttle surface of the apparatus;

second folding means positioned downstream from the first folding means, second folding means cooperating with the shuttle means for folding the front and rear panels to a fully folded position placing the minor side panels in contact with the bottom panel, the second folding means comprising top major panel biasing means for biasing each of the top major panels downwardly and inwardly such that the inner surface of each of the top major panels overlies the inner surface of the bottom panel and for generally placing each of the top major panels in contact with an edge of the minor side panels;

a single pair of spaced-apart adhesive applicators for applying adhesive only to the outer surface of each of the forward minor side panels and the rearward minor side panels during downstream travel thereof as the partially folded blank is guided downstream by the shuttle means and travels between each of said pair of spaced-apart adhesive applicators, the second folding means cooperating with said applicators for holding the minor side panels in their fully folded position; and compressing means positioned downstream from the adhesive applicators for compressing the top minor panels and the major side panels against the minor side panels having adhesive thereon so that the inner surfaces of the top minor panels and the major side panels press against the outer surface of the minor side panels of the blank to thereby adhesively secure the blank in an erect tray forming position.

2. A tray forming apparatus according to claim 1, wherein said loading means comprises:

vertical conveying means operable between a first position for receiving the blank from the stored position and a second position for lifting the blank to a vertically displaced position above the stored position; and horizontal conveying means operable between the vertically displaced position and the position within said apparatus for folding the blank, said horizontal conveying means operable with said vertical conveying means for sequentially conveying the blank from the stored position to the initial folding position within said apparatus.

3. A tray forming apparatus according to claim 2, wherein said vertical and horizontal conveying means comprise vacuum cups for contacting a surface of the blank and attaching to the blank under pressure sufficient for conveying the blank from the stored position to the initial forming position.

4. A tray forming apparatus according to claim 1, wherein said first folding means comprises:

a platen having a length and width dimension proximate the length and width dimension of the bottom panel for fitting within the bottom panel of the blank;

fold guiding means cooperating with said platen for receiving the blank and inwardly folding the minor side panels, front and rear panels; and platen moving means for moving said platen from a first position above the blank, biasing against the blank when in the initial folding position, and moving the blank through said fold guiding means to a position on the shuttle surface wherein the front and rear minor side panels are generally perpendicular to their respective front and rear panels.

5. A tray forming apparatus according to claim 4, wherein said fold guiding means comprises:

minor side panel guide arms positioned for cooperating with said platen in receiving and folding the minor side panels;

a pair of opposing front and rear panel guide arms positioned for receiving the blank after receipt by said minor side panel guide arms; and a pair of opposing major side panel guide arms positioned below said minor side panel guide arms for cooperating with said platen in folding the major side panels to the partially folded position at the obtuse angle to the bottom panel.

6. A tray forming apparatus according to claim 5, wherein the obtuse angle is sufficient for cooperating with the adhesive applicators in permitting the application of adhesive only to the outer surface of each minor side panel.

7. A tray forming apparatus according to claim 4, further comprising a frame having a rear portion, a front portion, and a side loading portion, said shuttle surface carried within said frame guide rails extending along said shuttle surface from the rear portion to the front portion of said frame, and wherein said shuttle means comprises a shuttle guide arm operable between the rear portion and the front portion of the frame for moving the partially formed blank downstream guided by said guide rails, and shuttle arm drive means carried by the frame and operable with the shuttle guide arm for moving the blank downstream.

8. A tray forming apparatus according to claim 7, wherein said second folding means comprises a pair of top panel guide arms positioned above said shuttle surface, wherein the partially formed blank is received therebetween and for cooperating with said shuttle guide arm for folding the major panels and the top major panels into their respective fully folded positions.

9. A tray forming apparatus according to claim 1, wherein said single pair of spaced-apart adhesive applicators comprises a glue gun positioned for depositing hot glue onto the minor side panels.

10. A tray forming apparatus according to claim 1, wherein said compressing means comprises:

a compression arm for each of the front and rear minor side panels, said compression arm movable from a stored position above the partially formed blank to a compression position wherein an end portion of said compression arm is biased against the bottom panel;

a first clamp carried by each compression arm, said first clamp positioned for biasing its respective minor side panel against the bottom panel when the compression arm is in the compression position with its arm bottom portion biased against the bottom panel;

a second clamp carried by each compression arm, said second clamp having an angle bend for folding the top minor panel over and at an acute angle to the minor side panel; and a pair of opposing compression plates positioned for receiving the blank and its partially folded major side panels therebetween, said pair of opposing compression plates movable for receiving and biasing the major side panels and top minor panels against their respective minor side panels having adhesive thereon for fully folding the blank into the tray.

11. A tray forming apparatus for forming a tray from a paperboard blank having a plurality of cuts and fold lines, the blank having a bottom panel, a pair of major side panels connected to the bottom panel along a common fold line, front and rear panels, each connected to the bottom panel along respective common fold lines, a pair of front minor side panels each respectively connected along common fold lines to the front panel, a pair of rear minor side panels each respectively connected to the rear panel, a pair of top major panels each respectively connected to the front and rear panels along a common fold line, a pair of top minor panels connected to each of the top major panels along common fold lines, the apparatus comprising:

loading means for loading one of a plurality of blanks to be transported along a predetermined path of travel from a stored position to an initial folding position for folding into a partially formed tray;

folding means for folding the blank into a partially formed condition wherein front and rear panels are in a folded position generally perpendicular to the bottom panel thus placing the minor side panels in contact with the bottom panel, said folding means biasing each of the top major panels downwardly and inwardly such that the inner surface of each of the top major panels overlies the inner surface of the bottom panel and placing each of the top major panels in contact with an edge of the minor side panels, said folding means further folding the pair of major side panels at an obtuse angle to the bottom panel;

a pair of spaced-apart adhesive applicators adjacent and along a downstream path of travel from said folding means, said pair of applicators operable for applying adhesive only to the outer surface of each of the forward minor side panels and the rearward minor side panels during downstream travel thereof, said folding means cooperating with said applicators for holding the minor side panels in their fully folded position; and compressing means positioned adjacent and downstream from the adhesive applicators for compressing the partially formed blank having adhesive thereon and forming the blank into a tray.

12. A tray forming apparatus according to claim 11, wherein the path of travel for the blank being handled by said loading means comprises a vertical path from the stored position to a horizontal path to the initial folding position, said vertical and horizontal paths within an imaginary plane perpendicular to the downstream path of travel.

13. A tray forming apparatus according to claim 11, wherein said loading means comprises:

vertical conveying means operable between a first position for receiving the blank from the stored position and a second position for lifting the blank to a vertically displaced position above the stored position; and horizontal conveying means operable between the vertically displaced position and the initial folding position for folding the blank, said horizontal conveying means operable with said vertical conveying means for sequentially conveying the blank from the stored position to the initial folding position within said apparatus.

14. A tray forming apparatus according to claim 13, wherein said vertical and horizontal conveying means comprise vacuum cups for contacting a surface of the blank and attaching to the blank under pressure sufficient for conveying the blank from the stored position to the initial forming position.

15. A tray forming apparatus according to claim 11, wherein said folding means comprises:

a platen having a length and width dimension proximate the length and width dimension of the bottom panel for fitting within the bottom panel of the blank;

fold guiding means cooperating with said platen for receiving the blank and inwardly folding the minor side panels, front and rear panels; and platen moving means for moving said platen from a first position above the blank, biasing against the blank when in the initial folding position, and moving the blank through said fold guiding means to a position on the shuttle surface wherein the front and rear minor side panels are generally perpendicular to their respective front and rear panels.

16. A tray forming apparatus according to claim 15, wherein said fold guiding means comprises:

minor side panel guide arms positioned for cooperating with said platen in receiving and folding the minor side panels;

a pair of opposing front and rear panel guide arms positioned for receiving the blank after receipt by said minor side panel guide arms; and a pair of opposing major side panel guide arms positioned below said minor side panel guide arms for cooperating with said platen in folding the major side panels to the partially folded position at the obtuse angle to the bottom panel.

17. A tray forming apparatus according to claim 16, wherein the obtuse angle is sufficient for cooperating with the adhesive applicators in permitting the application of adhesive only to the outer surface of each minor side panel.

18. A tray forming apparatus according to claim 11, further comprising a frame having a rear portion, a front portion, and a side loading portion, a shuttle surface carried within frame guide rails extending along said shuttle surface from the rear portion to the front portion of said frame, and shuttle guide means operable between the rear portion and the front portion of the frame for moving the partially formed tray along the downstream path of travel guided by said guide rails for moving the blank downstream.

19. A tray forming apparatus according to claim 18, wherein said folding means comprises a pair of top panel guide arms positioned above said shuttle surface, wherein the partially formed blank is received therebetween for cooperating with said shuttle guide means for folding the major panels and the top major panels into their respective fully folded positions.

20. A tray forming apparatus according to claim 11, wherein said pair of spaced-apart adhesive applicators comprises a single glue gun positioned on each side of the partially formed tray for depositing hot glue onto the minor side panels.

21. A tray forming apparatus according to claim 11, wherein said compressing means comprises:

a compression arm for each of the front and rear minor side panels, said compression arm movable from a stored position above the partially formed tray to a compression position wherein an end portion of said compression arm is biased against the bottom panel;

a first clamp carried by each compression arm, said first clamp positioned for biasing its respective minor side panel against the bottom panel when the compression arm is in the compression position with its arm bottom portion biased against the bottom panel;

a second clamp carried by each compression arm, said second clamp having an angle bend for folding the top minor panel over and at an acute angle to the minor side panel; and a pair of opposing compression plates positioned for receiving the partially formed tray and its partially folded major side panels therebetween, said pair of opposing compression plates movable for receiving and biasing the major side panels and top minor panels against their respective minor side panels having adhesive thereon for fully folding the blank into the tray.

22. A tray forming apparatus for forming a tray from a paperboard blank having a plurality of cuts and fold lines, the blank having a bottom panel, a pair of major side panels connected to the bottom panel along a common fold line, front and rear panels, each connected to the bottom panel along respective common fold lines, a pair of front minor side panels each respectively connected along common fold lines to the front panel, a pair of rear minor side panels each respectively connected to the rear panel, a pair of top major panels each respectively connected to the front and rear panels along a common fold line, a pair of top minor panels connected to each of the top major panels along common fold lines, the tray forming apparatus comprising:

first folding means for folding the blank into a partially formed condition by folding the front and rear minor side panels to a position generally perpendicular to their respective front and rear panels, folding the front and rear panels of the blank upwardly from the bottom panel and inwardly to a partially upright position, and folding the major side panels to a partially folded position at an obtuse angle to the bottom panel, said first folding means positioning the bottom panel onto a shuttle surface of said apparatus;

shuttle means for conveying the partially formed blank downstream from said first folding means along a shuttle surface of said apparatus;

second folding means positioned downstream from said first folding means, second folding means cooperating with said shuttle means for folding the front and rear panels to a fully folded position placing the minor side panels in contact with the bottom panel, said second folding means comprising top major panel biasing means for biasing each of the top major panels downwardly and inwardly such that the inner surface of each of the top major panels overlies the inner surface of the bottom panel and for generally placing each of the top major panels in contact with an edge of the minor side panels;

adhesive applicator means for applying adhesive only to the outer surface of each of the forward minor side panels and the rearward minor side panels during downstream travel thereof as the partially folded blank is guided downstream by said shuttle means and travels between each of said pair of spaced-apart adhesive applicators, said second folding means cooperating with said applicators for holding the minor side panels in their fully folded position; and compressing means positioned downstream from the adhesive applicator means for compressing the partially folded blank to thereby adhesively secure the blank into an erected tray.

23. A tray forming apparatus according to claim 22, further comprising loading means for conveying a blank along a predetermined path from a stored position to an initial folding position within said apparatus for folding into a partially formed tray.

24. A tray forming apparatus according to claim 23, wherein said loading means comprises:

vertical conveying means operable between a first position for receiving the blank from the stored position and a second position for lifting the blank to a vertically displaced position above the stored position; and horizontal conveying means operable between the vertically displaced position and the position within said apparatus for folding the blank, said horizontal conveying means operable with said vertical conveying means for sequentially conveying the blank from the stored position to the initial folding position within said apparatus.

25. A tray forming apparatus according to claim 24, wherein said vertical and horizontal conveying means comprise vacuum cups for contacting a surface of the blank and attaching to the blank under pressure sufficient for conveying the blank from the stored position to the initial forming position.

26. A tray forming apparatus according to claim 22, wherein said first folding means comprises:

a platen;

fold guiding means cooperating with said platen for receiving the blank and inwardly folding the minor side panels, front and rear panels; and platen moving means for moving said platen from a first position above the blank, biasing against the blank when in the initial folding position, and moving the blank through said fold guiding means to a position on the shuttle surface wherein the front and rear minor side panels are generally perpendicular to their respective front and rear panels.

27. A tray forming apparatus according to claim 26, wherein said fold guiding means comprises:

minor side panel guide arms positioned for cooperating with said platen in receiving and folding the minor side panels;

a pair of opposing front and rear panel guide arms positioned for receiving the blank after receipt by said minor side panel guide arms; and a pair of opposing major side panel guide arms positioned below said minor side panel guide arms for cooperating with said platen in folding the major side panels to the partially folded position at the obtuse angle to the bottom panel.

28. A tray forming apparatus according to claim 27, wherein the obtuse angle is sufficient for cooperating with the adhesive applicators in permitting the application of adhesive only to the outer surface of each minor side panel.

29. A tray forming apparatus according to claim 22, wherein said second folding means comprises a pair of top panel guide arms positioned above said shuttle surface, wherein the partially formed blank is received therebetween and for cooperating with said shuttle guide arm for folding the major panels and the top major panels into their respective fully folded positions.

30. A tray forming apparatus according to claim 22, wherein said compressing means comprises:

a compression arm for each of the front and rear minor side panels, said compression arm movable from a stored position above the partially formed blank to a compression position wherein an end portion of said compression arm is biased against the bottom panel;

a first clamp carried by each compression arm, said first clamp positioned for biasing its respective minor side panel against the bottom panel when the compression arm is in the compression position with its arm bottom portion biased against the bottom panel;

a second clamp carried by each compression arm, said second clamp having an angle bend for folding the top minor panel over and at an acute angle to the minor side panel; and a pair of opposing compression plates positioned for receiving the blank and its partially folded major side panels therebetween, said pair of opposing compression plates movable for receiving and biasing the major side panels and top minor panels against their respective minor side panels having adhesive thereon for fully folding the blank into the tray.

31. A method for forming a tray from a flat paperboard blank having a plurality of cuts and fold lines, the blank having a bottom panel, a pair of major side panels connected to the bottom panel along a common fold line, front and rear panels, each connected to the bottom panel along respective common fold lines, a pair of front minor side panels each respectively connected along common fold lines to the front panel, a pair of rear minor side panels each respectively connected to the rear panel, a pair of top major panels each respectively connected to the front and rear panels along a common fold line, a pair of top minor panels connected to each of the top major panels along common fold lines, the tray forming method comprising the steps of:

loading a blank by conveying it along a predetermined path from a stored position to an initial folding position for folding into a partially formed tray;

initially folding the blank into a partially formed condition comprising the steps of:

folding the front and rear minor side panels to a position generally perpendicular to their respective front and rear panels;

folding the front and rear panels of the blank upwardly from the bottom panel and inwardly to a partially upright position; and folding the major side panels to a partially folded position at an obtuse angle to the bottom panel, said initially folding step positioning the bottom panel onto a shuttle surface of the apparatus;

conveying the partially formed blank downstream along a shuttle surface;

folding the front and rear panels to a fully folded position for placing the minor side panels in contact with the bottom panel, the front and rear panel folding step comprising the step of biasing each of the top major panels downwardly and inwardly such that the inner surface of each of the top major panels overlies the inner surface of the bottom panel and for generally placing each of the top major panels in contact with an edge of the minor side panels;

applying adhesive from a single pair of spaced-apart applicators only to the outer surface of each of the forward minor side panels and the rearward minor side panels during downstream travel thereof as the partially folded blank is guided downstream and travels between each of said pair of spaced-apart adhesive applicators; and compressing the top minor panels and the major side panels against the minor side panels having adhesive thereon so that the inner surfaces of the top minor panels and the major side panels press against the outer surface of the minor side panels of the blank, thereby adhesively securing the blank in an erect tray forming position.

32. A tray forming method according to claim 31, wherein the loading step comprises the steps of:

lifting the blank from a stored position to a vertically displaced position above the stored position; and conveying the blank horizontally from the displaced position to the initial folding position.

33. A tray forming method according to claim 32, wherein the loading steps comprise the steps of contacting a surface of the blank with vacuum cups and attaching the cups to the blank under pressure sufficient for the lifting and conveying steps.

34. A tray forming method according to claim 31, wherein the step of initially folding the blank comprises the steps of:

biasing a platen against the bottom panel of the blank; and inwardly folding the minor side panels, front and rear panels by moving the blank through folding guides to a position on a shuttle surface wherein the front and rear minor side panels are generally perpendicular to their respective front and rear panels.

35. A tray forming method according to claim 34, wherein the folding guides comprise:

minor side panel guide arms positioned for cooperating with the platen in receiving and folding the minor side panels;

a pair of opposing front and rear panel guide arms positioned for receiving the blank after receipt by said minor side panel guide arms; and a pair of opposing major side panel guide arms positioned below said minor side panel guide arms for cooperating with said platen in folding the major side panels to the partially folded position at the obtuse angle to the bottom panel.

36. A tray forming method according to claim 35, wherein the obtuse angle is sufficient for cooperating with the adhesive applicators in permitting the application of adhesive only to the outer surface of each minor side panel.

37. A tray forming method according to claim 34, further comprising the step of:

biasing a shuttle guide against the partially formed tray for conveying the partially formed tray downstream along guide rails extending along a shuttle surface; and moving the partially formed blank downstream guided by the guide rails.

38. A tray forming method according to claim 37, wherein the front and rear panel folding step comprises the steps of:

receiving the partially formed tray between top panel guide arms positioned above the shuttle surface for cooperating with the shuttle guide arm for folding the major panels and the top major panels into their respective fully folded positions therebetween and for cooperating with said shuttle guide arm; and folding the major panels and the top major panels into their respective fully folded positions.

39. A tray forming method according to claim 31, wherein the adhesive applying step comprises the step of providing a single pair of spaced-apart adhesive applicators positioned for depositing hot glue onto the minor side panels.

40. A tray forming method according to claim 31, wherein the compressing step comprises the steps of:

moving a compression arm from a stored position above a travel path for the partially formed tray to a position for biasing the arm against the bottom panel;

biasing the compression arm against the bottom panel proximate each of the front and rear minor side panels;

clamping each minor side panel against the bottom panel;

folding the top minor panel over and at an acute angle to the minor side panel; and moving a pair of opposing compression plates toward the partially folded tray; and biasing the major side panels and top minor panels against their respective minor side panels having adhesive thereon for fully folding the blank into the tray.

41. A method for forming a tray comprising the steps of:

initially folding a flat paperboard blank into a partially formed condition comprising the steps of:

folding front and rear minor side panels of the blank to a position generally perpendicular to each of their respective front and rear panels;

folding front and rear panels of the blank upwardly from the bottom panel and inwardly to a partially upright position; and folding major side panels to a partially folded position at an obtuse angle to the bottom panel, said initially folding step positioning the bottom panel onto a shuttle surface of the apparatus;

conveying the partially folded blank downstream along a shuttle surface;

folding the front and rear panels to a fully folded position for placing the minor side panels in contact with the bottom panel;

applying adhesive only to the outer surface of each of the forward minor side panels and the rearward minor side panels; and compressing the top minor panels and the major side panels against the minor side panels having adhesive thereon so that the inner surfaces of the top minor panels and the major side panels press against the outer surface of the minor side panels of the blank, thereby adhesively securing the blank in an erect tray forming position.

42. A tray forming method according to claim 41, further comprising the step of loading a flat paperboard blank for the initially folding step by conveying it along a predetermined path from a stored position to an initial folding position for folding into a partially formed tray.

43. A tray forming method according to claim 42, wherein the loading step comprises the steps of:

lifting the blank from a stored position to a vertically displaced position above the stored position; and conveying the blank horizontally from the displaced position to the initial folding position.

44. A tray forming method according to claim 43, wherein the lifting and conveying steps comprise the steps of contacting a surface of the blank with vacuum cups and attaching the cups to the blank under pressure sufficient for the lifting and conveying steps.

45. A tray forming method according to claim 41, wherein the front and rear panel folding step comprises the step of biasing each of the top major panels downwardly and inwardly such that the inner surface of each of the top major panels overlies the inner surface of the bottom panel and for generally placing each of the top major panels in contact with an edge of the minor side panels.

46. A tray forming method according to claim 41, wherein the adhesive applying step comprises the step of applying hot glue from a single pair of spaced-apart applicators.

47. A tray forming method according to claim 41, wherein the step of initially folding the blank comprises the steps of:

biasing a platen against the bottom panel of the blank; and inwardly folding the minor side panels, front and rear panels by moving the blank through folding guides to a position on a shuttle surface wherein the front and rear minor side panels are generally perpendicular to their respective front and rear panels.

48. A tray forming method according to claim 46, wherein the folding guides comprise:

minor side panel guide arms positioned for cooperating with the platen in receiving and folding the minor side panels;

a pair of opposing front and rear panel guide arms positioned for receiving the blank after receipt by said minor side panel guide arms; and a pair of opposing major side panel guide arms positioned below said minor side panel guide arms for cooperating with said platen in folding the major side panels to the partially folded position at the obtuse angle to the bottom panel.

49. A tray forming method according to claim 41, further comprising the steps of:

biasing a shuttle guide against the partially formed tray for conveying the partially formed tray downstream along guide rails extending along a shuttle surface; and moving the partially formed blank downstream guided by the guide rails.

50. A tray forming method according to claim 41, wherein the front and rear panel folding step comprises the steps of:

receiving the partially formed tray between top panel guide arms positioned above the shuttle surface for cooperating with the shuttle guide arm for folding the major panels and the top major panels into their respective fully folded positions therebetween and for cooperating with said shuttle guide arm; and folding the major panels and the top major panels into their respective fully folded positions.

51. A tray forming apparatus according to claim 41, wherein the compressing step comprises the steps of:

moving a compression arm from a stored position above a travel path for the partially formed tray to a position for biasing the arm against the bottom panel;

biasing the compression arm against the bottom panel proximate each of the front and rear minor side panels;

clamping each minor side panel against the bottom panel;

folding the top minor panel over and at an acute angle to the minor side panel; and moving a pair of opposing compression plates toward the partially folded tray; and biasing the major side panels and top minor panels against their respective minor side panels having adhesive thereon for fully folding the blank into the tray.

* * * * *